United States Patent [19]

Schoch

[11] Patent Number: 4,466,318

[45] Date of Patent: Aug. 21, 1984

[54] DRIVE SYSTEM FOR A CUTTING STATION IN A PLATEN PRESS

[75] Inventor: Gregor Schoch, Crissier, Switzerland

[73] Assignee: Bobst SA, Lausanne, Switzerland

[21] Appl. No.: 483,663

[22] Filed: Apr. 11, 1983

[30] Foreign Application Priority Data

Apr. 15, 1982 [CH] Switzerland ..... 2276/82

[51] Int. Cl.[3] ..... B26D 5/00

[52] U.S. Cl. ..... 83/62; 83/94; 83/277; 83/526; 83/566; 83/646

[58] Field of Search ..... 83/61, 62, 94, 277, 83/604, 630, 509, 646, 571, 572, 526, 69, 569, 566

[56] References Cited

U.S. PATENT DOCUMENTS

| | | | |
|---|---|---|---|
| 1,053,566 | 2/1913 | Bredenberg . | |
| 2,043,246 | 6/1936 | Hawkes . | |
| 2,425,040 | 8/1947 | Luehrs . | |
| 3,182,588 | 5/1965 | Bolliger | 83/646 |
| 3,203,288 | 8/1965 | Blumer | 83/328 |
| 3,393,589 | 7/1968 | Mills | 83/62 |
| 3,727,505 | 4/1973 | Shaughnessy | 83/526 |
| 3,991,639 | 11/1976 | Pfeifer | 83/61 |
| 4,013,003 | 3/1977 | Finsterwalder et al. . | |

FOREIGN PATENT DOCUMENTS

K16179 11/1955 Fed. Rep. of Germany .

*Primary Examiner*—James M. Meister
*Assistant Examiner*—J. L. Knoble
*Attorney, Agent, or Firm*—Hill, Van Santen, Steadman & Simpson

[57] ABSTRACT

A drive system for the cutting station in a platen press has four toggle joints supporting the platen and each having a cam follower for moving the toggle joint by an associated rotating cam. The four toggle joints are disposed in pairs perpendicularly to the transport direction of sheets in the press. The pairs of toggle joints are aligned, with one pair of toggle joints being disposed between the other pair. The toggle joints are connected to a release device controlled by a security coupling. The cams are mounted on a common shaft provided at one end with a braking mechanism. Declutching of the security coupling simultaneously commands operation of each release device and of the braking mechanism.

11 Claims, 7 Drawing Figures

DRIVE SYSTEM FOR A CUTTING STATION IN A PLATEN PRESS

BACKGROUND OF THE INVENTION

1. Field of the Invention

The present invention relates to a drive means for the cutting station in a platen press, and in particular to a drive means for the cutting station in a platen press having a lower movable platen and an upper fixed platen with a means for actuating the lower movable platen.

2. Description of Prior Art

Drive devices for use in the cutting station of platen presses which operate by means of a driving cam and a group of toggle joints connected to the lower movable platen for actuating upward and downward movement of the platen are known in the art, such as those devices described, for example, in U.S. Pat. No. 1,053,566, U.S. Pat. No. 2,043,246, and U.S. Pat. No. 2,425,040.

U.S. Pat. No. 1,053,566 described the use of a cam mounted on a shaft outside of the toggle joint system. In this device, the movement generated by the cam is transferred to the toggle joint system by means of a lever equipped with cam followers.

U.S. Pat. No. 2,043,246 describes a drive means for a press having a cam on the access of symmetry of a toggle joint system. The cam is mounted on a shaft located beneath the lower pivot points of the toggle joints. A set of levers is connected at one end to a cam follower. A guide device is mounted on the axle carrying the cam follower for centering the system and determining the lateral position of the cam follower axle, so that forces are equally distributed to the toggle joints.

U.S. Pat. No. 2,425,040 also describes a drive means acting on the lower platen of a press. The device disclosed therein utilizes a cam having inner grooves for controlling motion of the lower platen. The movement generated by the cam is transferred to a stirrup linked by a lever to each toggle joint. Guiding of the lower platen is achieved by means of a central slide.

Each of the above devices permits variation in the stroke, speed and acelleration of the movement of the lower platen. Each of those devices, however, make use of one or more levers mounted between the toggle joints and the cams for transferring motion therebetween, which complicate the geometry of the driving device and increase the possibility of inaccurate movement because of the existence of a number of pivot points. Moreover, such structures exert substantial load on the contact surfaces between the cams and the cam followers, because the toggle joints are generally actuated in pairs by means of a single cam. Furthermore, none of the above devices has a security device which is capable of acting directly on the toggle joints in the event of a malfunction or a shutdown of the press.

SUMMARY OF THE INVENTION

It is an object of the present invention to provide a drive means for the cutting station in a platen press utilizing toggle joints arranged in pairs actuated by cams having a simple geometry and precise movement which does not substantially deteriorate due to wear over time.

It is another object of the present invention to provide such a drive means wherein the load on the contact surfaces between the cams and the cam followers is reduced.

Another object of the present invention is to provide such a drive means which can be utilized in combination with a security device acting directly on the toggle joints.

The above objects are inventively achieved in a drive device for the cutting station in a platen press having a lower movable platen and an upper fixed platen and means for transporting sheets through the platen press wherein the lower movable platen is supported on toggle joints each having two arms connected by an axle and semicylindrical swivels, the axle of each toggle joint being equipped with a cam follower resting on the surface of an associated cam mounted on a shaft. The shaft is driven by a worm gear engaging a worm driven by a drive shaft. The toggle joints are disposed in pairs with each pair of toggle joints being located on a theoretical axis perpendicular to forward movement of the sheets through the press. One pair of toggle joints is disposed between the other pair of toggle joints. The lower movable platen is urged or pulled away from the upper platen by spring-biased pulling means. The cam followers are urged against the surface of respective cams by compression springs attached at one end to a lower crosspiece in the cutting station and at the other end to an arm of one of the toggle joints. The toggle joints are also mounted on the crosspiece by means of cylindrical swivels centered in a bearing mounted on a toggle joint release device. The release device includes a piston rod having a piston head reciprocating in a chamber of a yoke connected to the crosspiece. The drive shaft for the worm has a braking system at one end thereof. The release device for the toggle joints and the braking system for the driveshaft are each controlled by a hydraulic control circuit which causes the braking system and the release device to operate simultaneously should the press unexpectedly stop or otherwise malfunction and which can independently control the braking system for normal stopping.

DESCRIPTION OF THE PREFERRED EMBODIMENTS

Figure 1:
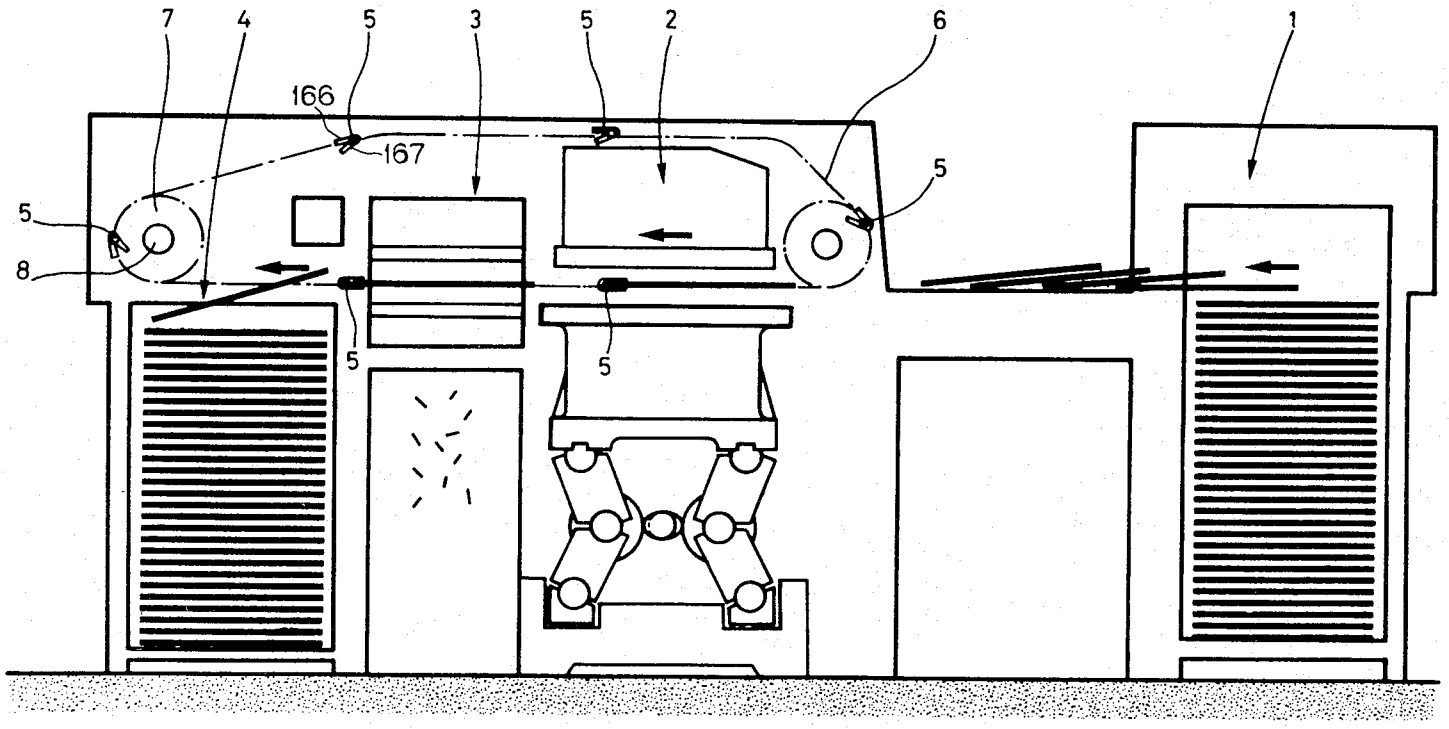
FIG. 1 is a side view of a platen press having a cutting station of the type in which the drive means disclosed and claimed herein may be employed.

A platen press is shown in simplified side view in FIG. 1 for the purpose of generally identifying the various stations thereof. The press includes a feed station 1, a cutting station 2, a stripping station 3 and an ejection station 4 at which cut sheets accumulate. The sheets to be processed in the platen press are entered at the feed station 1, transported by grippers 5 through the cutting station 2 and the stripping station 3 until reaching the ejection station 4, at which point the grippers 5 release the sheets which are then piled. The grippers 5 are mounted on gripper bars 124 disposed perpendicularly relative to the transport direction of the sheets through the platen press. The grippers 5 on the gripper bar 124 comprise two jaws 166 and 167 tightened in a plane corresponding to the plane defined by the lower face 168 of the gripper bars 124. Each bar provided with such grippers 5 is mounted on a chain 6 driven by a chain wheel 7 mounted on a shaft 8. The shaft rotating the chain wheel 7 is provided with a security coupling (described in greater detail below). The security coupling activates a hydraulic control circuit for emergency stopping, described in detail in connection with FIG. 7. The control circuit becomes operative, or is cut into the system, as soon as an overload occurs in driving the endless chain 6.

Figure 2:
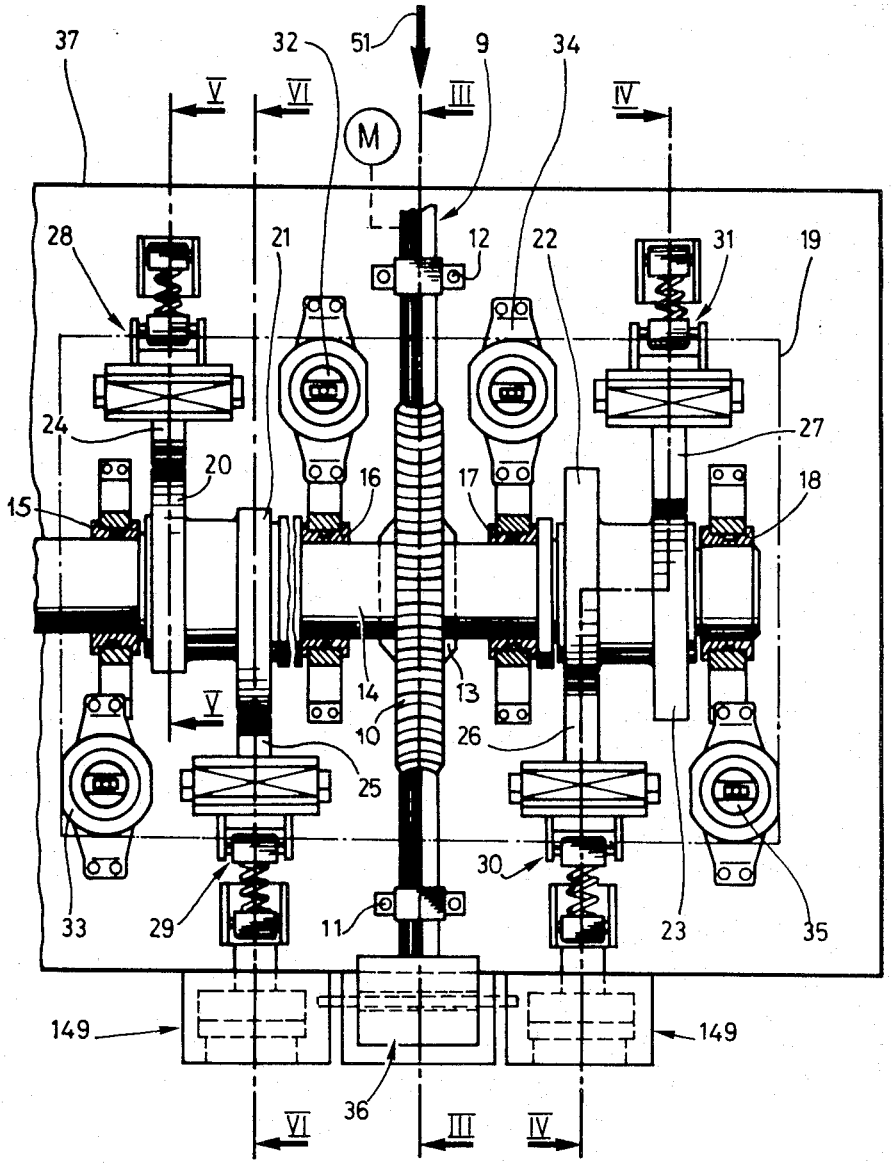
FIG. 2 is a plan view of the cutting station of a platen press constructed in accordance with the principles of the present invention.

A plan view of the cutting station 2 for the platen press is shown in FIG. 2. For purposes of clarity, the outline of the lower platen 19 (and the upper platen in registry therewith) is represented by dot-dash lines. The cutting station 2 has a driveshaft 9 driven by a drive means M and carrying a worm 10. The driveshaft 9 is supported by bearings 11 and 12. The worm 10 engages a worm gear 13 mounted on a shaft 14 supported by bearings 15, 16, 17 and 18. The shaft 14 also carries cams 20, 21, 22 and 23 having respective cam followers 24, 25, 26 and 27. The cam followers 24, 25, 26 and 27 are respectively mounted on "knuckles" or toggle joints 28, 29, 30 and 31. The lower movable platen 19 is urged away from the upper platen by pulling means 32, 33, 34 and 35. The toggle joints 28, 29, 30 and 31 are arranged in pairs perpendicularly to the transport direction 51 of the sheets through the machine. The toggle joints 29 and 30 are disposed between the toggle joints 28 and 31. The pulling means 32 and 34 are disposed between the toggle joints 28 and 31, and the pulling means 33 and 35 are disposed on each side of the toggle joints 29 and 39. The driveshaft 9 is provided at one end with a braking system 36, described in detail below.

Figure 3:
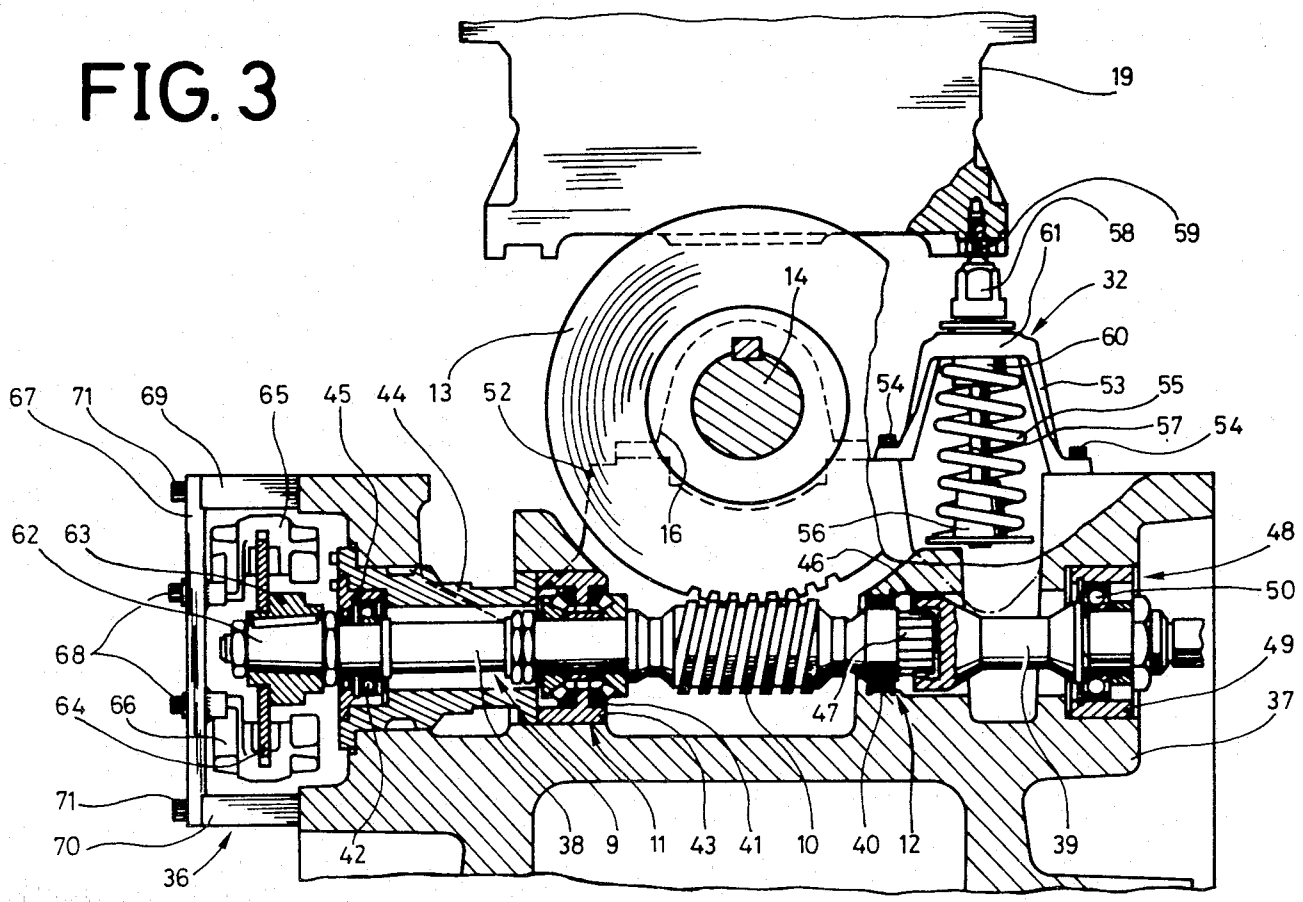
FIG. 3 is a sectional view taken along line III—III of FIG. 2.

Further details of the cutting station are shown in FIG. 3 wherein identical reference numerals are utilized to identify the same components shown in FIG. 2. As shown in FIG. 3, the cutting station 2 has a frame or lower crosspiece 37 on which the drive means for the movable lower platen 19 are mounted. One such drive means is the drivehshaft 9 carrying the worm 10. The driveshaft 9 consists of two semicylindrical shafts 38 and 39. The semicylindrical shaft 38, which carries the worm 10, is supported at one end by the bearing 12, which is a cylindrical roller bearing 40. The other end rests on a bearing 11 which is a pair of cone-shaped roller bearings 41, and a ball bearing 42. The pair of cone-shaped bearings 41 is mounted in a sleeve 43. The sleeve 43 may be moved on a tube 44, on which a disc 45 carrying the ball bearing 42 is also mounted. The tube 44 is tightened against one of the faces of the lower crosspiece 37.

The half shaft 39 is coupled to the half shaft 38 with inner teeth 46 engaging exterior teeth 47 carried at one end of the half shaft 39. The half shaft 39 rests on the lower crosspiece 37 by means of a bearing 48 in the form of a socket 49 having a ball bearing 50 mounted on the side thereof. This arrangement permits adequate alignment of the bearings and avoids the use of a rigid one piece shaft supported by four bearings, as utilized in conventional drive means for cutting stations.

The half shaft 38 has a cone-shaped end 62 carrying a hub 63 on which a brake disc 64 is tightened. Two jaws 65 and 66 surround the brake disc 64 and act thereon upon actuation of the jaws 65 and 66 to cease rotation of the driveshaft 9. The jaws 65 and 66 are fastened with screws 68 against an end face 67. The end face 67 is connected to the lower crosspiece 37 by braces 69 and 70 provided with tightening screws 71.

As described in connection with FIG. 2, the worm gear 13 is mounted on the shaft 14 supported by bearings 15, 16, 17 and 18, of which bearing 16 can be seen in FIG. 3. Each of the bearings 15, 16, 17 and 18 is mounted on a boss 52 formed on the lower crosspiece 37. The movable platen 19 is urged downwardly by pulling means 32, 33, 34 and 35 each comprised of a cup 53, fastened with screws 54 to the lower crosspiece 37, and a compression spring 55. The compression spring 55 is connected at one end to the bottom of the cup 53 and at its other end to a stop 56 carried at the end of a centrally disposed rod 57. The rod 57 is connected by a coupling 58 to a swivel 59 fastened to the movable platen 19. The cup 53 has a bearing 60. The rod 57 does not extend into the bearing 60 of the cup 53, thus permitting inclination of the platen 19 with respect to the bottom 61 of the cup 53.

Figure 4:
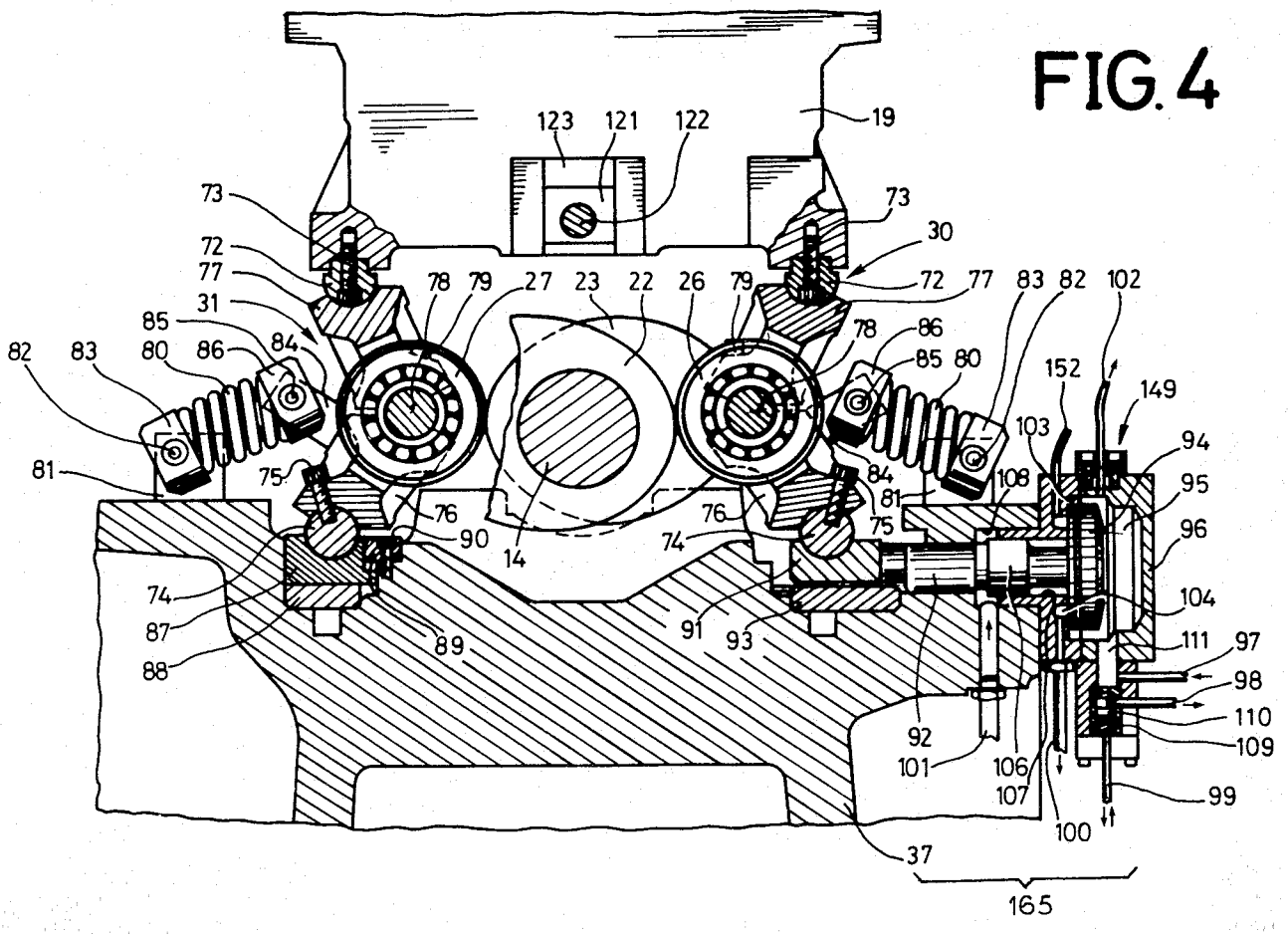
FIG. 4 is a section view taken along line IV—IV of FIG. 2.

Further details of the cutting station are shown in sectional view of FIG. 4. The movable platen 19 has four semicylindrical swivels 72, only two of which can be seen in FIG. 4. The semicylindricals 72 are fastened to the movable platen 19 with screws 73. Each semicylindrical swivel functions as the upper support for its associated toggle joint, toggle joints 30 and 31 being visible in FIG. 4. The lower support for each toggle joint is a cylindrical swivel 74 connected with a screw 75 to each arm 76 of the respective toggle joints. Each toggle joint also has an arm 77 connected to its associated semicylindrical swivel 72.

The arms 76 and 77 are pivotably linked with each other by an axle 78. The axles 78 for each toggle joint carry the cam follower associated therewith, cam followers 22 and 23 being visible in FIG. 4. The axle 78 is tightened to the arm 77 by a screw 79. Pressure urging the respective cam followers 24, 25, 26 and 27 against the surfaces of the cams 20, 21, 22 and 23 is provided by a compression spring 80 disposed at the exterior of each toggle joint 28, 29, 30 and 31. The compression spring 80 is attached at one end of the lower crosspiece 37 and at its other end to the arms 76 of each toggle joint. The compression spring 80 is fastened to the lower crosspiece 37 by a fork 81 provided with an axle 82 extending through a cap 83 receiving one end of the compression spring 80. A cap 86 receiving the opposite end of the compression spring 80 is mounted in a stirrup carried on the arm 76 by means of an axle 85.

Each cylindrical swivel 74 for the toggle joints 28 and 31 (see FIG. 2) is centered in a half bearing 87 mounted on a cone-shaped stop 88 received in the lower crosspiece 37. The cone-shaped stop 88 vertically positions the axles for the cylindrical swivels 74. Such positioning occurs with the shifting of each cone-shaped stop 88 and the locking of the stop by means of a locking system (not shown). The half bearing 87 is guided by a slide 89 fastened to the lower crosspiece 37 by screws 90.

The toggle joints 29 and 30 rest on cylindrical swivels 74, each of which are mounted on a half bearing 91, connected to a security system 165. The half bearing 91 rests on a cone-shaped stop 93, the adjustment of which occurs identically to the cone-shaped stop 88 for the toggle joints 28 and 31.

The security system 165 includes a piston rod 92 having a piston head 94 located in a chamber 95 of a yoke 96. The piston head 94 is pressed against a face 103 of the chamber 95 by means of a holding pressure generated by hydraulic fluid such as oil supplied via a conduit 97. The face 103 of the chamber 95 has a circular channel 104 communicating with the atmosphere (the air contained in the oil resevoir) through a conduit 100. The chamber 95 is also connected to a draining device 105 (see FIG. 7) via a conduit 102.

The piston rod 92 consists of a piston 106 sliding in a cylinder 107 disposed in the yoke 96. The piston 106 closes a compression chamber 108 receiving oil under pressure via a conduit 101. The pressure in the chamber 105 is maintained by a pilot distributor 109 leading into the chamber 95. The pilot pressure acts on the piston 110 through a conduit 99. The oil of the pilot valve is evacuated via a conduit 98 to a main tank 112 (see FIG. 7).

The movable platen 19 is guided by two shoes 121 mounted inside two lateral frames (not shown). The shoes 121 are disposed so as to be pivotable about an axle 122. The movable platen 19 is provided at its lateral faces with a slide 123 engaging the shoes 121.

Figure 5:
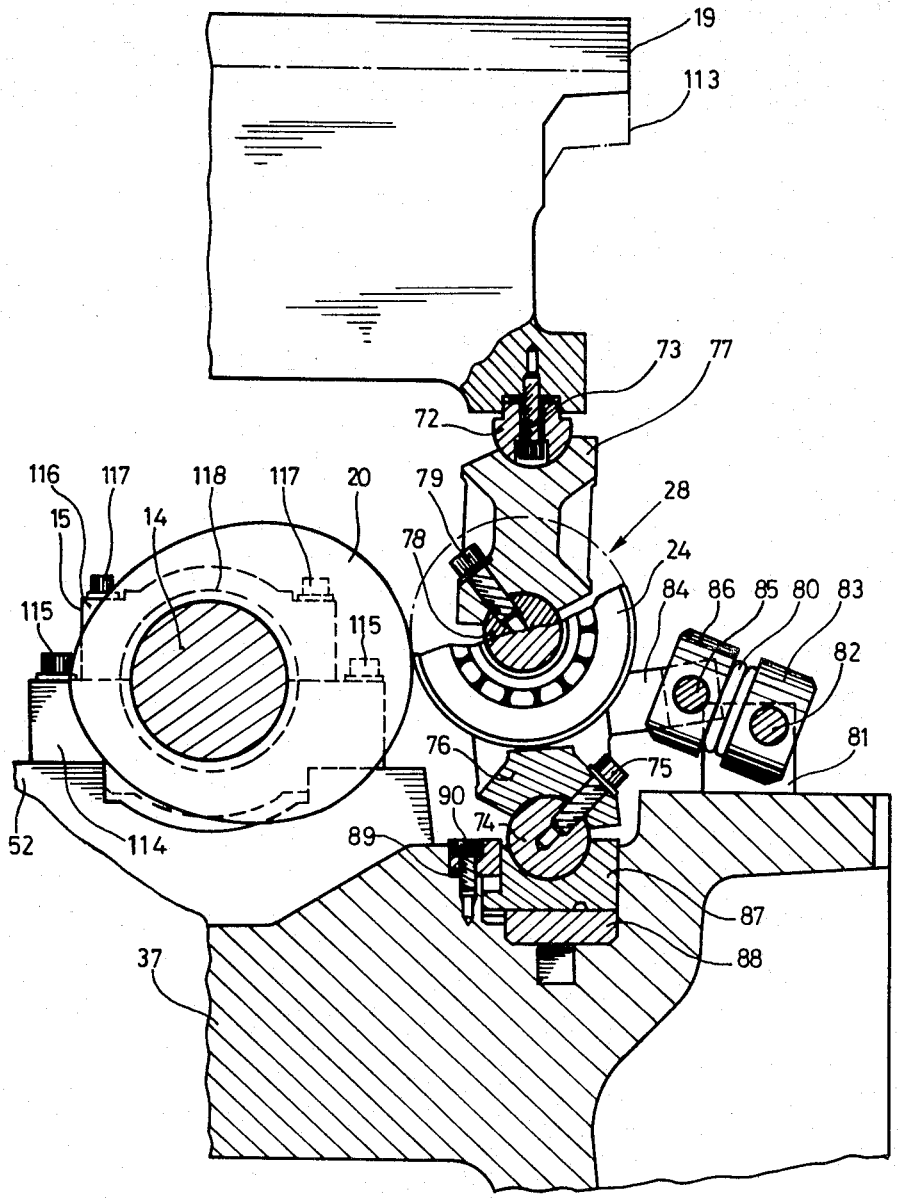
FIG. 5 is a sectional view taken along line V—V of FIG. 2.

A sectional view showing the toggle joint 28 in a stretched or extended position is shown in FIG. 5, that is, when the platen 19 is at its upper dead point. The lower dead point of the platen 19 is shown by the dashed lines 113. The bearing 15 visible in FIG. 5 (as well as the other bearings 16, 17 and 18) is comprised of an inferior clamp 114, tightened on the boss 52 by screws 115, and a superior clamp 116, tightened to the inferior clamp 114 with screws 117. The inferior clamp 114 and the superior clamp 116 form a bushing for the bearing.

Figure 6:
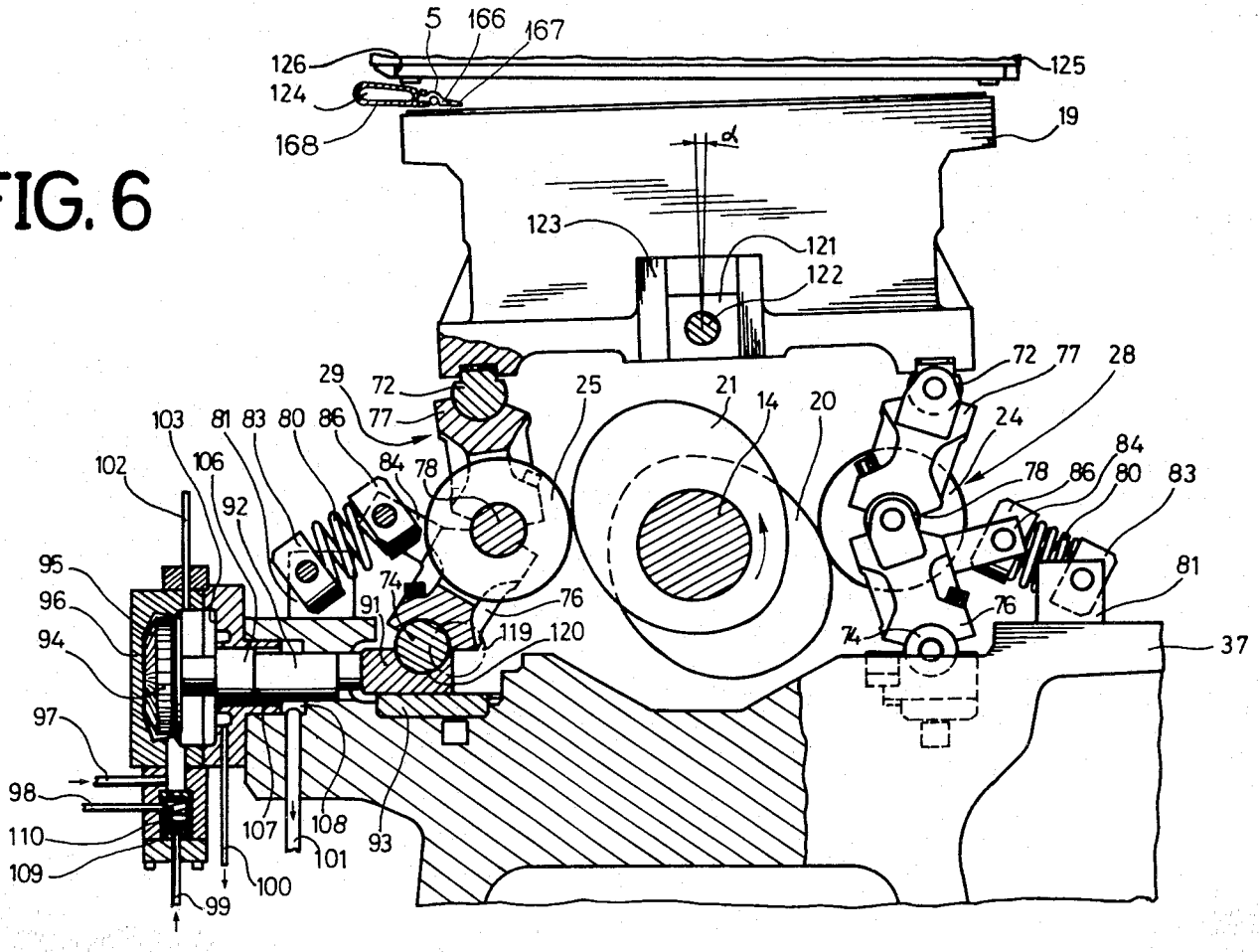
FIG. 6 is a sectional view taken along line VI—VI of FIG. 2.

A sectional view of the movable platen 19 and the associated drive and support components is shown in FIG. 6 in a released position, that is, when the axes of the cylindrical swivels 74 of the toggle joints 29 and 30 (see FIG. 2) have been shifted horizontally by the piston 106 from a position 119 to a position 120. This shifting causes pivoting of the movable platen 19 by an angle $\alpha$ with regard to the vertical. The movable platen 19 pivots about the axle 122 of the shoe 121. Such pivoting of the platen 19 prevents the gripper bar 124, located between the upper platen 125 and the movable platen 19, from being crushed in the event of a sudden stop of the press due to declutching of the security coupling 140 (shown in FIG. 7). In such presses, the gripper bar 124 may frequently stop when a jamming occurs. Stopping of the movable platen 19 is slower than stopping of the gripper bar 124. If the movable platen 19 stays parallel to the upper platen 125, the cutting tool 126 may crush the gripper bar 124. The drive system for the cutting station disclosed and claimed herein avoids this problem thereby preventing damage to the gripper bar 124.

Figure 7:
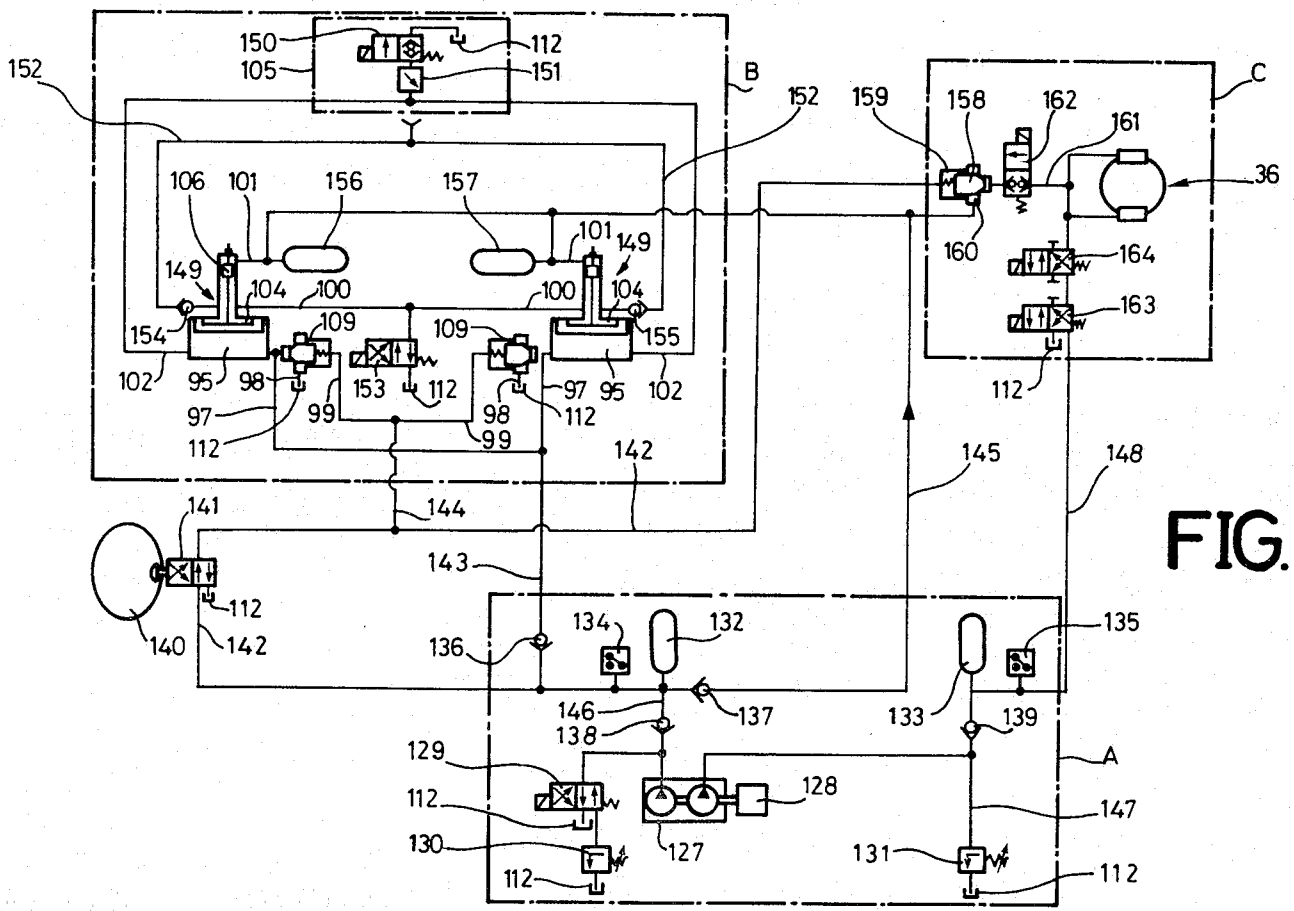
FIG. 7 is a schematic diagram of a hydraulic control circuit for operating a security device for controlling various components of the drive system disclosed and claimed herein.

FIG. 7 is a schematic diagram of a hydraulic circuit for the security device. The hydraulic circuit generally consists of three blocks A, B, C. The components in block A generate hydraulic pressure, and include a double-acting pump 127 driven by motor 128, a distributor 129, two pressure reducers 130 and 131, two pneumatic accumulators 132 and 133, two pressostats 134 and 135, and retaining valves 136, 137, 138 and 139. The double-acting pump 127 provides two different pressures, one of 150 bars and one of 50 bars. The 150 bars pressure is distributed to block B and block C and is available for use in the event of an emergency stop of the press. Emergency stopping of the platen press may result from the detection of an overload in the drive mechanism for the gripper bar 124. Such an overload can be detected by any number of means known to those skilled in the art, such as an elastic coupling 140 which is released upon the occurrence of an overload, actuating a pilot distributor 141. The 50 bars pressure is supplied to block C only and actuates the braking device 36 when the platen press is stopped normally. The 150 bars pressure is supplied to block B and C through conduits 142, 143, 144, 145 and 146. Oil is delivered from the pump 127 to the distributor 129 controlled by the pressostat 134 in the tube 142, and is then supplied to the pressure reducer 130 which sets the pressure at 110 bars. The valve 138 is disposed in the conduit 146 which is connected to conduits 142 and 145 as well as to the accumulator 132. A one-way valve 137 is also disposed in the conduit 145.

The conduit 142 supplies pressure to the block C and to block D via the conduit 144 upon connection thereof by means of the piloting valve 141. The 50 bars pressure is supplied to the block C by means of conduit 147 and 148, after being reduced to 40 bars by the pressure reducer 131.

The pressostat 145 in the conduit 148 controls the motor 128, so that the pressure in the conduit 148 is maintained between 15 and 20 bars. The conduit 147 is connected through a one-way valve 139 to the accumulator 133 and the conduit 148. The block B includes components for controlling the disengagement device for the toggle joints, two of which are shown in FIG. 7 referenced at 149. The operating pressure is supplied to each disengagement device for the toggle joints 149 via the conduits 97 connected to the conduit 143. Each chamber 95 of the disengagement device for the toggle joints is connected to a draining device 105 via conduits 102. The draining device 105 consists of a distributor 150 and a constriction 151. Each disengagement device for the toggle joints 149 is connected to the atmosphere by a distributor 153 supplied by a conduit 100.

In order to drain the oil from the circular channel 104, compressed air is forced into the conduit 152 having one-way valves 154 and 155. Pressure provided by the components of block A via the conduit 145 is supplied to the pressure chamber 108 through the conduit 101 connected to pneumatic accumulator 156 and 157.

In order to achieve simulatenous stopping of the platen press if the toggle joints are released, the pressure in the conduits 142 and 145 is supplied to block C. The pilot valve 158 has a chamber 159 supplied by the conduit 142 and the chamber 160 supplied by the conduit 145.

The braking system 36 is supplied with oil in order to operate in the event of jamming (declutching of the security coupling 140) by a conduit 161 through a valve 162, and is supplied by the conduit 148 for normal braking. The conduit 148 has valves 163 and 164.

The release device for the toggle joints 149 and the braking system 36 operates simultaneously in the event of stoppage of the platen press due to jamming. Under such circumstances, the hydraulic fluid from the conduit 142 is caused by the action of the pilot valve 141 to return to the tank 112 so that the pressure drops in the conduit 99. The pilot valve 141 then opens and oil under pressure in the chamber 95 of the release device for the toggle joints 149 flows back to the tank 112 through the conduit 98. As soon as the pilot valves 109 are open, the counter pressure in the conduit 101 acts on the piston 106, causing the piston head 94 to move permitting oil from the chamber 95 to flow as well through the conduit 100 into the channel 104. This substantially acellerates shifting of the piston 106. Simultaneously, the pilot valve 158 is opened and oil under pressure in the conduit 145 acts on the braking system 36, because the valve 162 is opened at this precise moment and the two valves 163 and 164 are closed. During normal braking of the machine the valves 163 and 164 are opened (with a so-called "stop" actuator (not shown)) and oil under pressure is permitted to flow from the conduit 148 to the jaws 64 and 65 of the braking system 36. After a stop caused by declutching of the security coupling 140 and restoration of the normal operating conditions of the press, the machine can again be started. This is accomplished by the pilot valve 141 permitting hydraulc fluid flow into the conduit 148, so that the chambers are again under pressure, as is the chamber 159 of the pilot valve 158. Pressure is also restored in the conduits 101 and compressed air is pulsed into the channel 104 to drain the remaining oil. The chamber 95 is drained by the draining device 105 and the valve 163 is again set toward the tank 112 to release the braking system and is again closed to prevent oil under pressure in the conduit 148 from affecting the braking system.

Although modifications and changes may be suggested by those skilled in the art it is the intention of the inventor to embody within the patent warranted hereon all changes and modifications as reasonably and properly come within the scope of his contribution to the art.

I claim as my invention:

1. In a platen press having a cutting station including a lower movable platen and an upper fixed platen, and a gripper bar means for transporting sheets through said press, a drive means for actuating said lower platen comprising:

four toggle joints interconnected between said lower platen and a fixed frame of said cutting station, said toggle joints being disposed in pairs and each pair of toggle joints being aligned on an axis perpendicular to the direction of sheet transport through said cutting station and one pair of toggle joints being disposed between the other pair, each toggle joint having two arms respectively connected by swivel means to said lower platen and said frame and having an axle pivotably connecting said arms;

a driveshaft connected to a drive means;

a camshaft in driving connection with said driveshaft carrying four cams thereon;

four cam followers respectively engaging said four cams, said four cam followers being respectively mounted on said axles of said four toggle joints for inclining said lower platen relative to said upper platen;

four compression springs respectively interconnected between said frame and said toggle joints for urging said cam followers against said cams;

pulling means interconnected between said frame and said lower platen for urging said lower platen toward said frame in opposition to movement of said lower platen imparted by said toggle joints;

two toggle joint release means contained in said frame each having a bearing receiving one of said swivel means of the toggle joints in one of said pairs of toggle joints for immediately retracting said one pair of toggle joints upon actuation of said toggle joint release means such that said pulling means pulls one end of said lower platen toward said frame;

a brake means operable on said driveshaft for automatic braking thereof; and a hydraulic control means in hydraulic connection with said toggle joint release means and said brake means for simultaneous actuation thereof.

2. A drive means as claimed in claim 1 wherein each of said toggle joint release means comprises:

a piston rod connected to said bearing and extending through a channel in said frame and terminating in a piston head;

a yoke connected to said frame in communication with said channel, said yoke having a chamber receiving said piston head, said channel and said chamber in said yoke being in hydraulic connection with said hydraulic control means.

3. A drive means as claimed in claim 1 wherein said pulling means comprises:

a plurality of cups each having an open end connected to said frame;

a rod having a free end terminating in a stop and having an opposite end connected to a bottom of said cup; and a connection means swivelably connected to said lower platen and connected to said rod at said bottom of said cup.

4. A drive means as claimed in claim 1 wherein said brake means comprises:

a disc carried on said driveshaft; and a hydraulic clamping means partially surrounding said disc and connected to said hydraulic control means for clamping said disc and thereby stopping rotation of said driveshaft upon actuation thereof.

5. A drive means as claimed in claim 1 wherein said hydraulic control means includes a means for detecting overload of said transporting means and wherein said hydraulic control means immediately actuates said brake means and said toggle joint release means upon detection of said overload.

6. A drive means as claimed in claim 5 wherein said means for detecting said overload is an elastic coupling interconnected between said transporting means and a valve in said hydraulic control means, said elastic coupling being released upon the occurrence of an overload and actuating said valve.

7. A drive means as claimed in claim 5 wherein said hydraulic control means includes means for actuating said brake means independently of actuation of said toggle joint release means for normal stopping of said press.

8. A drive means as claimed in claim 2 wherein said yoke has a surface having a circular channel therein communicating with the atmosphere through a conduit in said yoke, said channel being covered by said piston head and permitting draining of hydraulic fluid from said chamber after actuation of said toggle joint release means.

9. A drive means as claimed in claim 8 further comprising a means for supplying compressed air to said channel for aiding in draining said hydraulic fluid.

10. A drive means as claimed in claim 2 further comprising a pilot valve in hydraulic communication with said chamber and actuated by said hydraulic control means for releasing hydraulic pressure in said chamber after actuation of said toggle joint release means for returning said toggle joint release means to an unactuated position.

11. A drive means as claimed in claim 1 wherein said driveshaft is connected to said camshaft by a worm carried by said driveshaft engaging a worm gear mounted on said camshaft.

* * * * *